US007654174B2

(12) United States Patent
Tachino et al.

(10) Patent No.: US 7,654,174 B2
(45) Date of Patent: Feb. 2, 2010

(54) TAPPET CLEARANCE ADJUSTMENT DEVICE

(75) Inventors: Yasuyuki Tachino, Tokyo (JP); Toshiyuki Miyajima, Tokyo (JP); Tomoaki Tsuyoshi, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 142 days.

(21) Appl. No.: 11/922,282

(22) PCT Filed: May 18, 2006

(86) PCT No.: PCT/JP2006/309961

§ 371 (c)(1),
(2), (4) Date: Dec. 14, 2007

(87) PCT Pub. No.: WO2007/000858

PCT Pub. Date: Jan. 4, 2007

(65) Prior Publication Data

US 2009/0107296 A1 Apr. 30, 2009

(30) Foreign Application Priority Data

Jun. 28, 2005 (JP) ..... 2005-189021

(51) Int. Cl.
*B25B 13/48* (2006.01)
*B25B 21/00* (2006.01)

(52) U.S. Cl. ..... 81/57.14; 81/9.24

(58) Field of Classification Search ..... 81/57.14, 81/9.24, 55–56; 123/90.45, 90.52
See application file for complete search history.

(56) References Cited

U.S. PATENT DOCUMENTS 3,988,925 A * 11/1976 Seccombe et al. ..... 73/114.79
6,474,283 B1 11/2002 Gidlund
6,973,905 B2 * 12/2005 Hathaway et al. ..... 123/90.45
2005/0205035 A1 * 9/2005 Hathaway et al. ..... 123/90.52
2006/0130792 A1 6/2006 Katou et al.

FOREIGN PATENT DOCUMENTS

| | | |
|---|---|---|
| JP | 57-081108 | 5/1982 |
| JP | 58-2800 | 1/1983 |
| JP | 60-069223 | 4/1985 |
| JP | 61-127924 | 8/1986 |
| JP | 05-065812 | 3/1993 |
| JP | 06-039655 | 2/1994 |
| JP | 06-53038 | 7/1994 |

(Continued)

*Primary Examiner*—D. S Meislin
(74) *Attorney, Agent, or Firm*—Carrier, Blackman & Associates P.C.; Joseph P. Carrier; William D. Blackman

(57) ABSTRACT

An adjustment unit has a driver for turning an adjustment screw, a sleeve having a hexagonal hole connected to a rotating shaft, an insertion member connected to the upper end of the driver and of which a part is inserted in the sleeve, a pipe concentrically provided around the driver and having at its forward end a socket for rotating an adjustment nut, and a gear body provided concentric with the pipe and rotating the pipe. The sleeve has a short tiltable support section in contact with the hexagonal hole. A gap is provided between the hexagonal hole of the gear body and a hexagonal column section of the pipe. The driver and the pipe tilt about the tilting support section as the fulcrum.

7 Claims, 13 Drawing Sheets

FOREIGN PATENT DOCUMENTS

| | | |
|---|---|---|
| JP | 07-109909 | 4/1995 |
| JP | 09-177520 | 7/1997 |
| JP | 2000-074762 | 3/2000 |
| JP | 2002-115512 | 4/2002 |
| JP | 2003-206712 | 7/2003 |
| JP | 2006-097519 | 4/2006 |
| WO | WO 2005/008035 | 1/2005 |

* cited by examiner

TAPPET CLEARANCE ADJUSTMENT DEVICE

CROSS-REFERENCE TO RELATED APPLICATIONS

The present application is a U.S. National phase of, and claims priority based on PCT/JP2006/309961, filed 18 May 2006, which, in turn, claims priority from Japanese patent application 2005-189021, filed 28 Jun. 2005. The entire disclosure of each of the referenced priority documents is incorporated herein by reference.

TECHNICAL FIELD

The present invention relates to a tappet clearance adjusting apparatus (device) for adjusting a clearance between a valve and an adjustment screw in an engine, in which a valve that is closed by a spring is opened by being pressed by an adjustment screw on a distal end of a rocker arm.

BACKGROUND ART

Engines of the type having a rocker arm in a valve mechanism draw in and discharge a fuel gas or an exhaust gas by pressing a valve end to open the valve with an adjustment screw on the distal end of a rocker arm that is actuated by a cam. When the rocker arm returns to its original position, the valve is closed again under the resiliency of a spring.

A clearance (hereinafter referred to as a tappet clearance) is provided between the valve end and the adjustment screw, for allowing the valve to be fully closed when the rocker arm returns to its original position. If the tappet clearance is too small, then the clearance may possibly be eliminated due to thermal expansion occurring at high temperatures. If the tappet clearance is too large, then the valve end and the adjustment screw produce large sounds as noise upon contact with each other. Therefore, the tappet clearance has to be adjusted accurately to an appropriate value (or an appropriate range), which is preset in design. Particularly, a process for manufacturing a large quantity of engines in a wide variety of types needs to have a reduced adjustment time per engine, while maintaining a high adjustment accuracy level. It is preferable to be able to adjust the tappet clearance automatically in order to prevent adjustment fluctuations.

In view of the foregoing, there has been proposed an apparatus for automatically adjusting a tappet clearance using an adjustment screw rotating mechanism, a cam shaft rotating mechanism, a displacement sensor for detecting an amount of valve lift, and a processing device (see, Japanese Laid-Open Patent Publication No. 7-109909).

The applicant of the present application has proposed a tappet clearance adjusting apparatus for detecting when a valve is brought into contact with a valve seat by detecting a torque value for rotating an adjustment screw, and for adjusting the tappet clearance quickly and highly accurately (see Japanese Patent Application No. 2004-283089). The adjusting apparatus should preferably have an adjustment screw and a screwdriver, which are held in proper coaxial engagement with each other, due to the need for highly accurately detecting a change in the torque value, at a time when the valve head is brought into contact with the valve seat. Therefore, an adjustment unit including a motor and the adjustment screw has an angle thereof set highly accurately by a robot.

However, since the angle of the adjustment screw varies depending on the amount of lift of the valve, a procedure for operating the robot becomes complex, in order to cause the robot to respond to changes in the angle of the adjustment screw. The adjustment screw may not necessarily be set at an appropriate direction, due to slight operational delays of the robot or the like.

For directing the screwdriver appropriately with respect to the adjustment screw, it may be proposed to use a bendable torque transmitting mechanism, such as the fastening device disclosed in Japanese Laid-Open Patent Publication No. 6-39655, for example.

However, the fastening device disclosed in Japanese Laid-Open Patent Publication No. 6-39655 includes a rotary mechanism at a bent tip portion thereof, which is too complex to rotate smoothly for detecting rotational torque with high accuracy. Even if the fastening device is able to hold the screwdriver in engagement with the adjustment screw and at an appropriate direction, the fastening device cannot be used to adjust the tappet clearance, since it is devoid of any mechanism for rotating the adjustment nut.

SUMMARY OF THE INVENTION

It is an object of the present invention to provide a tappet clearance adjusting apparatus, which is capable of bringing a screwdriver and a socket into appropriate engagement with an adjustment screw and an adjustment nut, respectively, and for rotating them smoothly.

According to the present invention, a tappet clearance adjusting apparatus, for adjusting a clearance between an adjustment screw with an adjustment nut threaded thereover and a valve end of an engine, comprises a screwdriver for rotating the adjustment screw, a first rotational driver for rotating the screwdriver, a sleeve connected to a rotatable shaft of the first rotational driver, the sleeve having a noncircular inner circumferential surface, an insert connected to an upper end of the screwdriver and including at least a portion thereof which is inserted into the sleeve, a pipe disposed concentrically around the screwdriver and supporting a socket for rotating the adjustment nut on a distal end thereof, and a second rotational driver disposed concentrically with the pipe for rotating the pipe, wherein the portion of the insert which is inserted into the sleeve has an axially short tilt support held in abutment against an inner wall surface of the sleeve, the second rotational driver has a noncircular inner wall, the pipe has a portion inserted into the inner wall and having a noncircular outer wall, and the pipe has a maximum outside diameter smaller than a maximum inside diameter of the inner wall, and greater than a minimum inside diameter of the inner wall.

The short tilt support, which is held in abutment against the inner wall surface of the sleeve, is axially movable back and forth inside the sleeve, and effectively bears the rotational drive force while abutting against the inner wall surface of the sleeve. Also, the tilt support is slightly tiltable in any direction, i.e., is maintained in a floating state. Consequently, the screwdriver fixed to the tilt support also is tiltable in any direction, depending on the direction of the adjustment screw, and thus may be set at an appropriate direction. The screwdriver is thus rotatable smoothly in unison with the adjustment screw, without being affected by the tilt angle of the rocker arm, and the torque for rotating the adjustment screw can be detected highly accurately by a predetermined torque sensor.

The pipe disposed concentric with the screwdriver is axially movable toward and away from the inner wall of the second rotational driver, and is rotatable by engagement with the inner wall surface thereof. The pipe is also tiltable within a range of a gap provided between the. pipe and the inner wall, depending on the tilt of the screwdriver. Therefore, when the screwdriver engages with the adjustment screw, the socket on the distal end of the pipe is tilted concentrically with the screwdriver and is fitted properly over the adjustment nut. The adjustment nut can thus appropriately be rotated before and after the adjustment screw has been adjusted.

Preferably, the tilt support has an axial length ranging from 1/10 to 1/2 the maximum diameter of the inner wall surface of the sleeve, for thereby enabling appropriate sliding movement, tilting movement, and rotation.

The tappet clearance adjusting apparatus may further comprise a bushing disposed between the socket and the screwdriver, or between a 1/2-long portion of the pipe, in a direction of the socket and the screwdriver. The bushing, which is disposed near to the distal end, keeps the screwdriver and the socket accurately concentric with each other. When the socket is fitted over the adjustment nut, the screwdriver is accurately fitted into a fitting slot of the adjustment screw.

The tappet clearance adjusting apparatus may further comprise a torque detector for detecting a torque used for rotating the adjustment screw, the torque detector comprising a first coupling connected to the first rotational driver, a second coupling coupled to the screwdriver and coaxial with the first coupling, a drive force transmitting engagement unit for transmitting a bidirectional rotation of the first coupling to the second coupling, and a load cell mounted on the drive force transmitting engagement unit for detecting a force in a circumferential direction, wherein the load cell is preloaded in the circumferential direction by a resilient member. With the load cell being preloaded by the resilient member, there is no clearance at the load cell, making it possible to measure the torque in a manner that is free of dead zones. In addition, bidirectional torques can be detected by a simple arrangement, using a single load cell.

The adjustment nut may comprise a nut with a flange, the socket having a distal end thereof, which is greater in diameter than the flange, and an annular beveled surface on an inner circumferential surface of the distal end thereof, for avoiding abutment against the flange. Since the socket includes such an annular beveled surface, when the fitting portion of the socket is fitted over the adjustment nut, the distal end of the socket does not ride onto an upper surface of the flange, whereby the socket can appropriately rotate the adjustment nut.

The socket may have an inner wall surface including a portion engaging the adjustment nut, and having a dimension that is 1.20 to 1.45 times greater than a dimension of an engaged portion of the adjustment nut.

With the tappet clearance adjusting apparatus according to the present invention, because gaps are provided between the outer walls of the tilt support and the pipe and the second rotational driver, the screwdriver and the socket are placed in a floating state for enabling tilting movement, sliding movement, and rotation. Therefore, depending on their directions, the screwdriver and the socket are appropriately oriented and held in engagement with the adjustment screw and the adjustment nut, thereby smoothly rotating the adjustment screw and the adjustment nut.

DETAILED DESCRIPTION INCLUDING BEST MODE FOR CARRYING OUT THE INVENTION

A tappet clearance adjusting apparatus according to an embodiment of the present invention shall be described below with reference to FIGS. 1 through 13 of the accompanying drawings.

Figure 1:
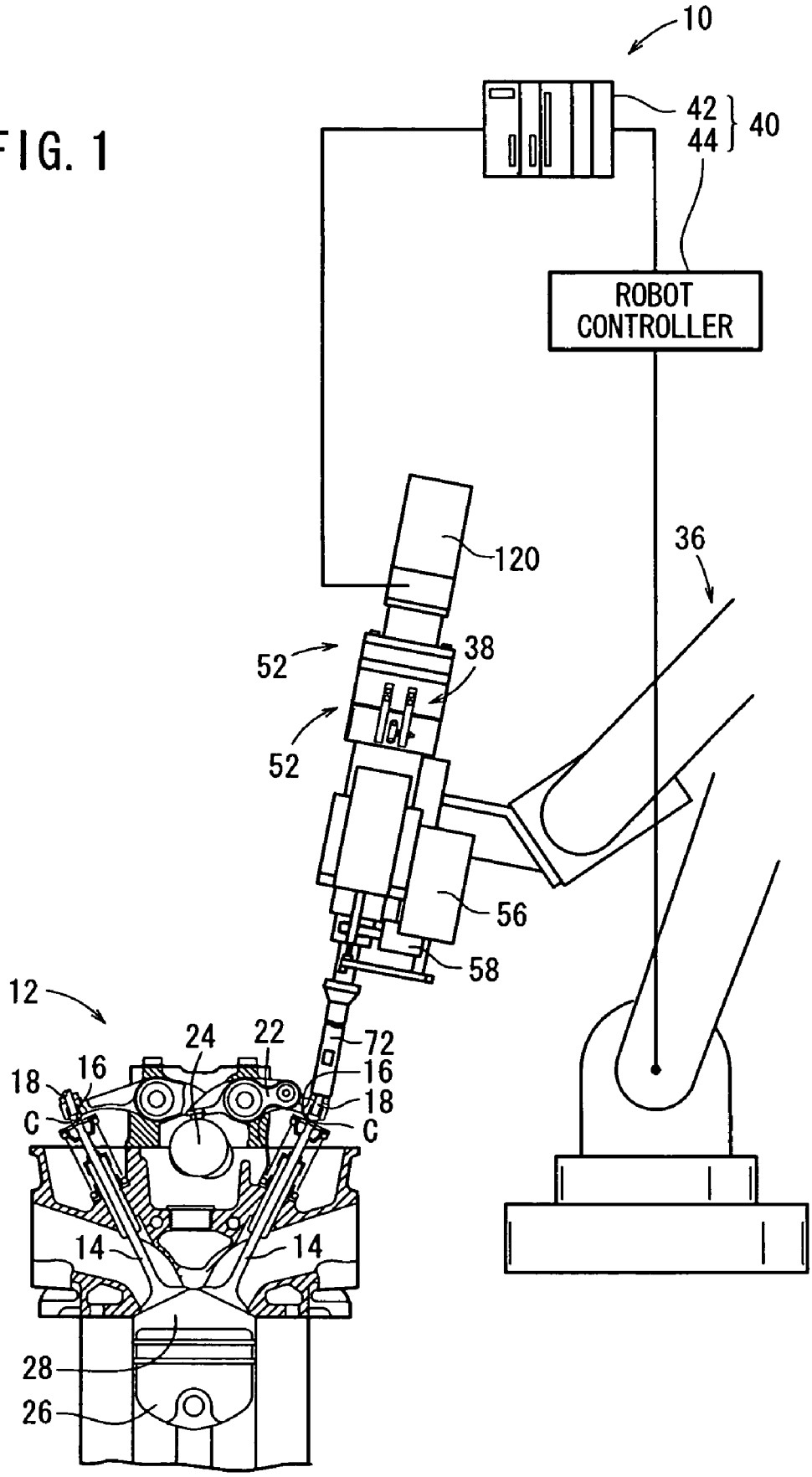
FIG. 1 is a block diagram of a tappet clearance adjusting apparatus according to an embodiment of the present invention.

As shown in FIG. 1, a tappet clearance adjusting apparatus 10 according to an embodiment of the present invention constitutes an apparatus for adjusting a clearance (hereinafter referred to as a tappet clearance) C between a valve end 16 of a valve 14 of an engine 12 and an adjustment screw 18. The adjustment screw 18 is a fine right-handed screw, which is advanced downwardly when it is rotated clockwise.

Figure 2:
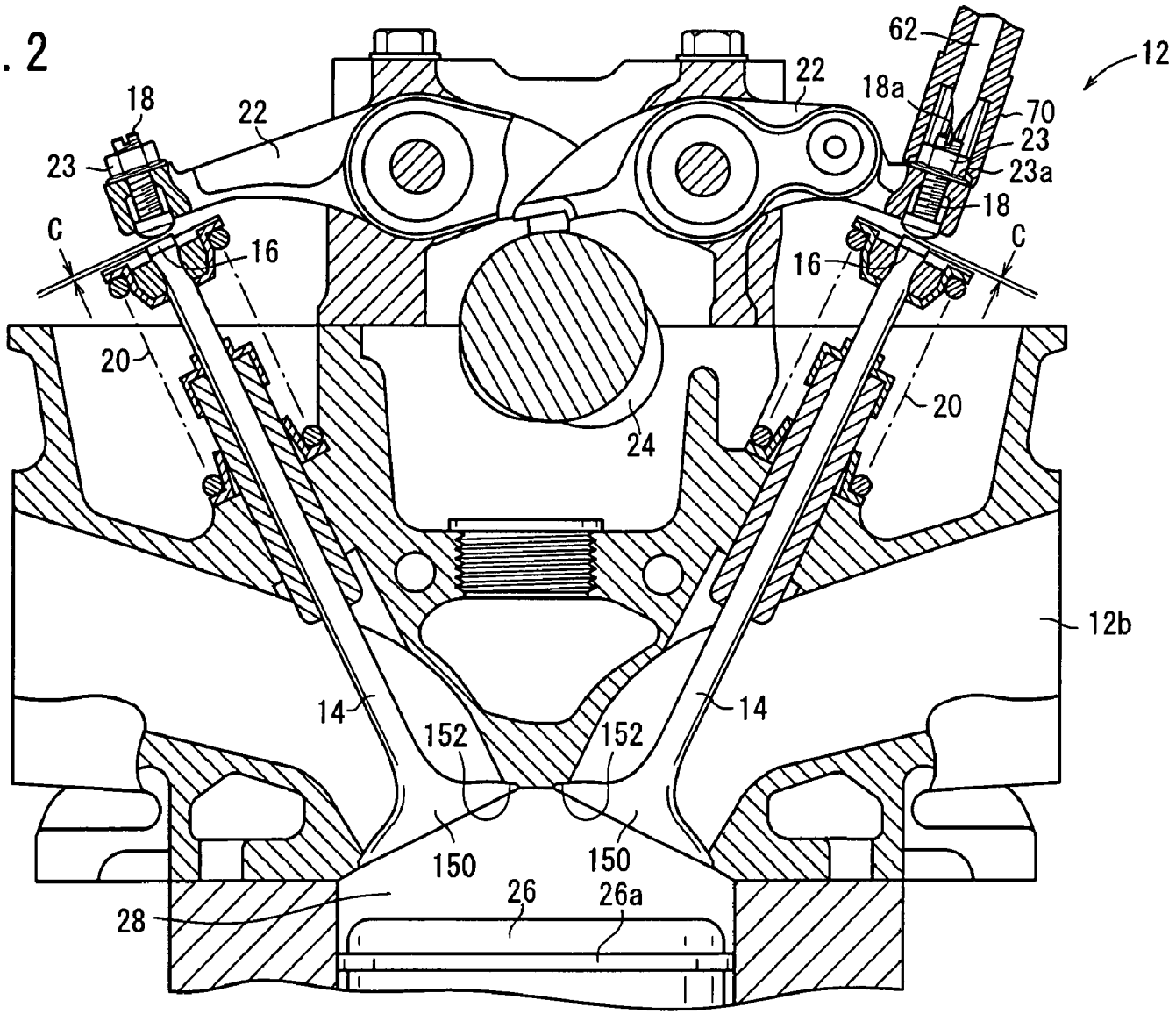
FIG. 2 is a cross-sectional view of an engine.

As shown in FIG. 2, the adjustment screw 18 includes a screw section having a straight slot 18*a* defined in an upper end thereof, the screw section being threaded into the distal end of a rocker arm 22. The adjustment screw 18 is fixed in place by an adjustment nut 23, in a double-nut configuration. The adjustment nut 23 comprises a nut having a flange 23*a* thereon (e.g., a nut according to ISO-4161, ISO-10663, JIS-B1190, or the like). The engine 12 is of a type wherein the valve end 16 of the valve 14, which is closed by a spring 20, is pressed by the adjustment screw 18 on the distal end of the rocker arm 22, so as to open the valve 14. Specifically, the rocker arm 22 is actuated by a cam 24 in order to cause the adjustment screw 18 to press the valve end 16, for thereby opening the valve 14 to either draw in a fuel gas or discharge an exhaust gas. When the rocker arm 22 returns to its original position, the valve 14 is closed again under the resiliency of the spring 20.

For adjusting the clearance C, the cam 24 is set such that the cam lobe is directed downwardly and the rocker arm 22 returns to its original position. Therefore, during both intake and exhaust strokes, the valves 14 are placed in positions for closing the intake pipe and an exhaust pipe, respectively, and a piston 26 ganged with the cam 24 is lifted to a top dead center position, thereby providing a combustion chamber 28 as a small space.

With the adjustment nut 23 loosened, the adjustment screw 18 is advanced or retracted to change the tappet clearance C when it is turned by a screwdriver 62, which is inserted into the straight slot 18*a* defined at the rear end of the adjustment screw 18. When the tappet clearance C is adjusted to a suitable value, the adjustment nut 23 is tightened in order to secure the adjustment screw 18.

Referring back to FIG. 1, the tappet clearance adjusting apparatus 10 includes an adjustment unit 34 for advancing and retracting the adjustment screw 18 after having loosened the adjustment nut 23, a robot 36 programmed for moving the adjustment unit 34 to a desired position and in a desired direction, a torque detector 38 for detecting a torque for rotating the adjustment screw 18, and a control mechanism 40 for controlling the adjustment unit 34 based on the torque value T as measured by the torque detector 38.

The control mechanism 40 has a PLC (Programmable Logic Controller) 42 and a robot controller 44. The PLC 42 stores successive torque values T in a given data register, performs a calculation process, controls the adjustment unit 34 based on the results of the calculation process, etc., and transmits a predetermined timing signal to the robot controller 44. Based on the received timing signal, the robot controller 44 controls the robot 36 in order to move and bring the distal end of the adjustment unit 34 into abutment against the adjustment screw 18. The robot 36 comprises a multiaxis industrial robot.

Figure 3:
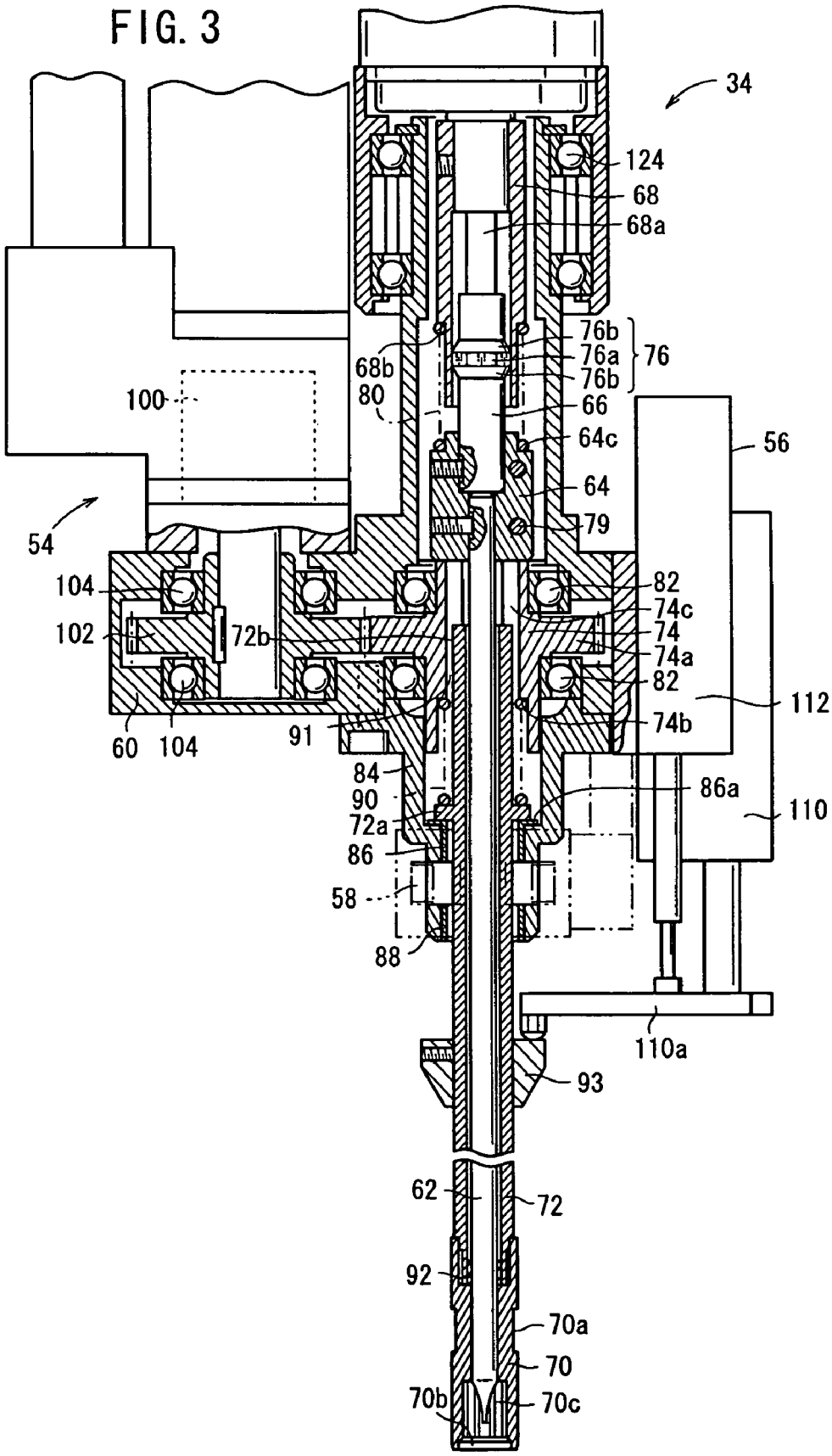
FIG. 3 is a sectional front elevational view of an adjustment unit.
Figure 4:
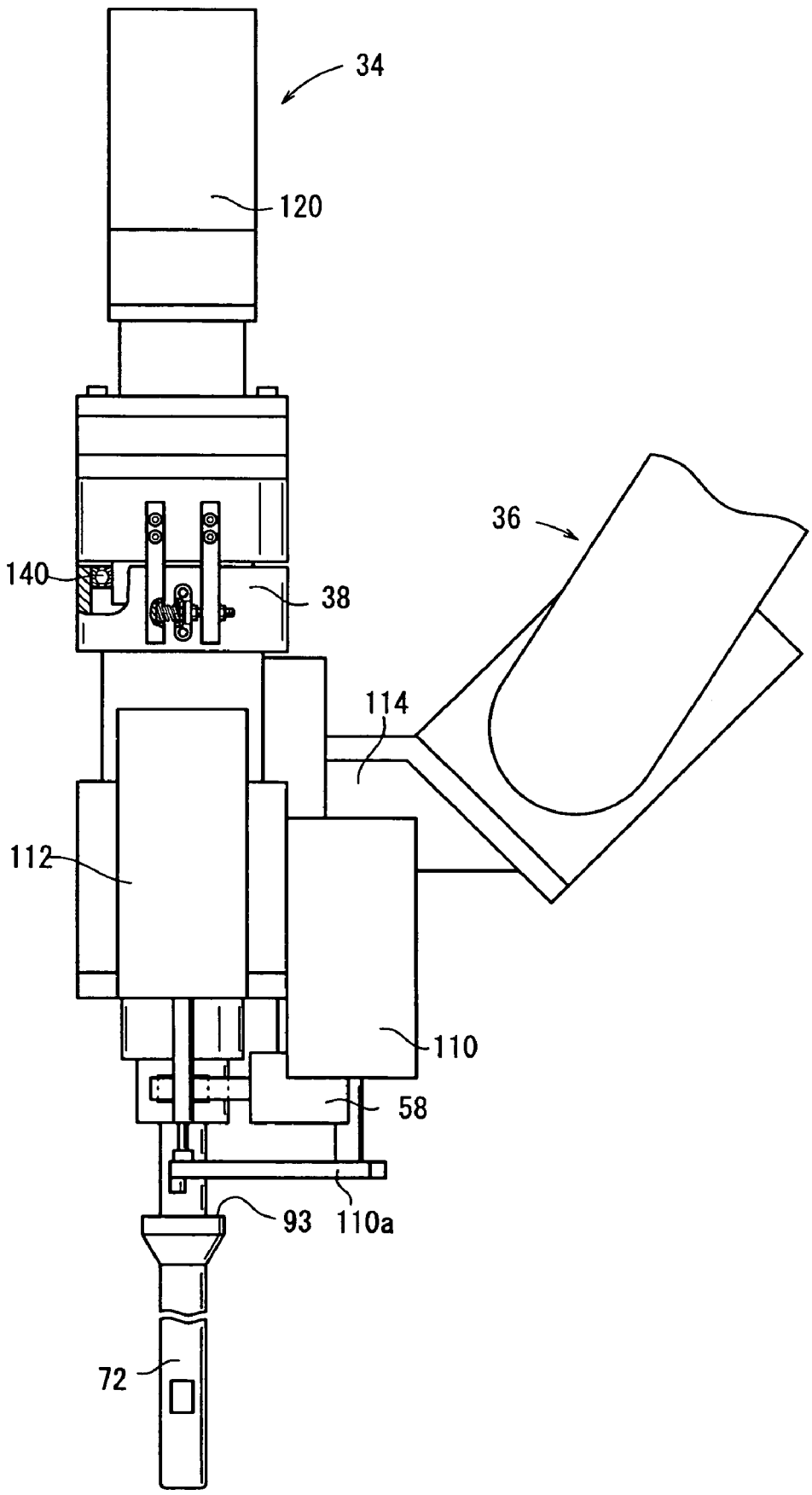
FIG. 4 is a side elevational view of the adjustment unit.

As shown in FIGS. 3 and 4, the adjustment unit 34 is mounted on the distal end of the robot 36. The adjustment unit 34 comprises a cylindrical working unit 50, a drive measuring unit 52 disposed coaxially with the working unit 50 and upwardly thereof, a nut runner 54 disposed adjacent and parallel to the drive measuring unit 52, a displacement measuring unit 56 disposed adjacent and parallel to the working unit 50, and a chuck 58.

Figure 5:
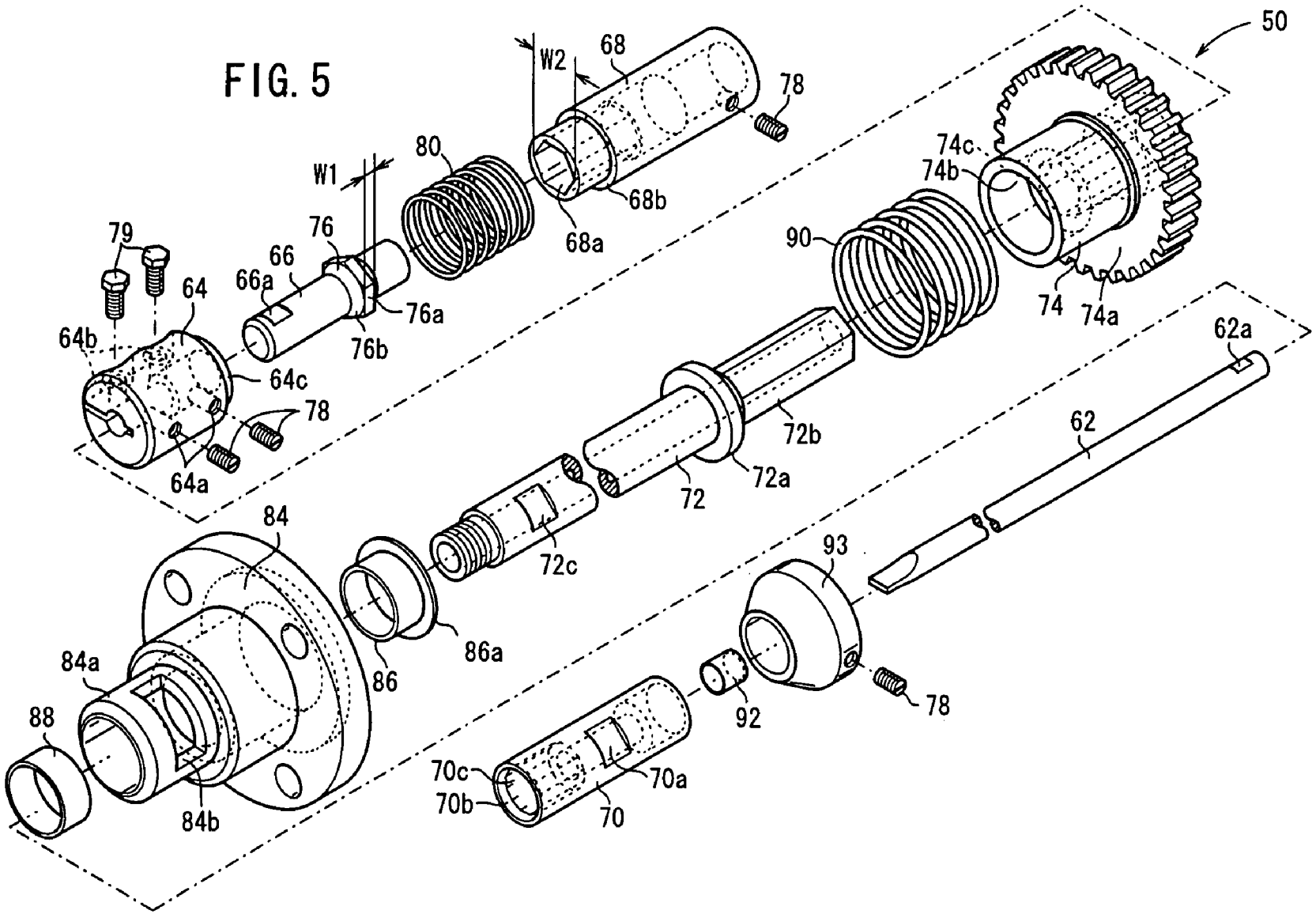
FIG. 5 is an exploded perspective view of a working unit.

As shown in FIGS. 3 and 5, the working unit 50, which is assembled in a housing 60 used as a base, comprises a screwdriver 62 for rotating the adjustment screw 18, an insert 66 connected to an upper end of the screwdriver 62 by an adapter 64, a sleeve 68 that receives an upper portion of the insert 66, which is slidably inserted therein, a pipe 72 disposed concentrically around the screwdriver 62 and supporting a socket 70 on a lower end thereof for rotating the adjustment nut 23, and a tubular gear body (second rotational driver) 74 for rotationally driving the pipe 72. The screwdriver 62 has an elongate bar shape with a straight flat distal end, and the screwdriver 62 is disposed in alignment with the central axis of the working unit 50. The pipe 72 is disposed concentrically around the screwdriver 62, and the socket 70 has a lower end, on a distal end thereof, which is positioned slightly below the lower end of the screwdriver 62.

The components of the working unit 50 shall be described below successively in an ascending order. The sleeve 68 is of a tubular shape with a stepped outer circumferential surface. The sleeve 68 includes an upper portion thereof fixed to the rotational shaft of the drive measuring unit 52. The sleeve 68 has a hexagonal hole 68*a* defined in a lower portion thereof. The insert 66 is inserted into the hexagonal hole 68*a*, and has a tilt support 76 that abuts against the inner wall surface of the hexagonal hole 68*a*.

The tilt support 76 comprises an axially short member, disposed substantially centrally on the insert 66, and has a diameter greater than the other portion of the insert 66. Specifically, the tilt support 76 comprises a hexagonal outer wall surface 76*a*, having an outer circumferential surface held in abutment against the inner wall surface of the hexagonal hole 68*a*, and a pair of support surfaces 76*b* that extend away from each other respectively from axially opposite ends of the hexagonal outer wall surface 76*a*. The support surfaces 76*b* are tapered such that the support surfaces 76*b* become progressively smaller in diameter in a direction away from the hexagonal outer wall surface 76*a*. The hexagonal outer wall surface 76*a* has a certain tolerance with respect to the hexagonal hole 68*a*, so that it can be tilted with respect to the hexagonal hole 68*a* depending on the tolerance. When the sleeve 68 rotates, the inner wall surface of the hexagonal hole 68*a* engages with the hexagonal outer wall surface 76*a*, thereby rotating the hexagonal outer wall surface 76*a* in order to rotate the insert 66. The insert 66 is movable back and forth while sliding against the inner wall surface of the hexagonal hole 68*a*. An axial length W1 (see FIG. 5) of the tilt support 76 should preferably be set to a value within a range from 1/10 to 1/2 of the distance between diametrical corners of the hexagonal hole 68*a* (or the hexagonal outer wall surface 76*a*), i.e., the maximum diameter thereof, for facilitating appropriate sliding movement, tilting movement, and rotation. The hexagonal outer wall surface 76*a* is reinforced in mechanical strength, while being made smooth in sliding movement, by the support surfaces 76*b*.

The inner wall surface of the sleeve 68 is not limited to a hexagonal shape, but may be of a square shape, a dodecagonal shape, or a noncircular shape. The inner wall surface of the sleeve 68 should preferably have a point-symmetrical shape with respect to the axis. In such a case, a side surface of the tilt support 76 on the insert 66 may be shaped complementarily to the inner wall surface of the sleeve 68.

The adapter 64 has a substantially C-shaped cross section, and secures in position the lower end of the insert 66 which is inserted into an upper end thereof, as well as the upper end of the screwdriver 62 which is inserted into a lower end thereof. Specifically, screws 78 are threaded into screw holes 64*a* defined radially in the adapter 64, such that the tip ends of the screws 78 press against respective screw bearing surfaces 66*a*, 62*a* of the insert 66 and the screwdriver 62. Bolts 79 are threaded into bolt holes 64*b* defined in opposite ends of the C-shaped adapter 64 in order to reduce the inside diameter of the adapter 64, and thereby tighten the screwdriver 62 and the insert 66 in position. The adapter 64 has a stepped outer circumferential surface 64*c* on an upper end thereof. A helical spring 80 is inserted slightly under compression between the stepped outer circumferential surface 64*c* of the adapter 64 and the stepped outer circumferential surface 68*b* of the sleeve 68. A lower end of the adapter 64 is held against an upper end face of the gear body 74, for protection against dislodgment under the downward resiliency of the helical spring 80.

When the screwdriver 62 engages the adjustment screw 18, the screwdriver 62 is movable back and forth while compressing the helical spring 80, depending on the distance that the adjustment screw 18 moves back and forth, and the screwdriver 62 is adequately pressed against the adjustment screw 18 under the resiliency of the helical spring 80. Therefore, the screwdriver 62 is reliably held in engagement with the adjustment screw 18.

The gear body 74 includes a tubular member having a hexagonal hole 74*c* defined by an inner wall surface thereof, and a driven gear 74*a* disposed on a substantially central outer circumferential surface of the tubular member. The gear body 74 is rotatably supported in the housing 60 by bearings 82. The gear body 74 includes a stepped inner circumferential surface 74*b* in a lower portion thereof.

Figure 6:
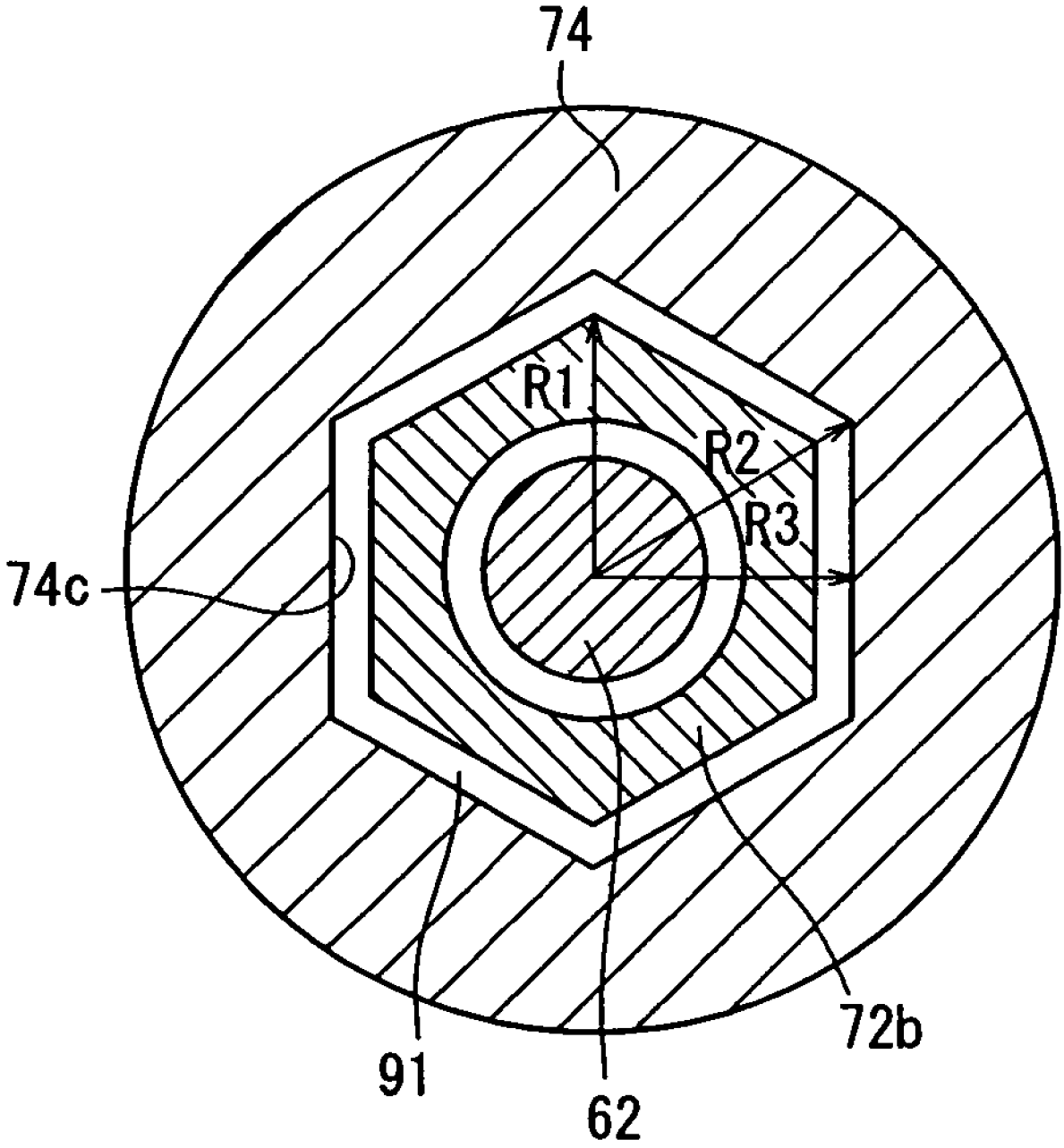
FIG. 6 is a horizontal cross-sectional view of a gear unit, a pipe, and a screwdriver.

The pipe 72 includes an upper portion in the form of a hexagonal post 72*b*, which is inserted in the hexagonal hole 74*c* of the gear body 74. As shown in FIG. 6, the hexagonal post 72*b* is smaller than the hexagonal hole 74*c* when viewed in cross section across the axis thereof, with a gap 91 defined therebetween. Specifically, the hexagonal post 72*b* has a maximum outside diameter R1, which is smaller than the maximum inside diameter R2 of the hexagonal hole 74*c*, and which is greater than the minimum inside diameter R3 of the hexagonal hole 74*c*. Therefore, the pipe 72 is axially movable back and forth inside the hexagonal hole 74*c* of the gear body 74, is rotatable when engaged by the inner wall surface of the hexagonal hole 74*c*, and is tiltable within a range provided by the gap 91.

The pipe 72 includes an annular ridge 72*a*. A helical spring 90 is inserted slightly under compression between the annular ridge 72*a* and the stepped inner circumferential surface 74*b* of the gear body 74. The annular ridge 72*a* has a lower surface held against the upper surface of a flange 86*a*, for protection against dislodgment under a downward resiliency of the helical spring 90. When the socket 70 on the distal end of the pipe 72 engages with the adjustment nut 23, the pipe 72 is movable back and forth while compressing the helical spring 90, depending on the distance that the rocker arm 22 is displaced, and the pipe 72 is adequately pressed against the upper end face of the rocker arm 22 under the resiliency of the helical spring 90. A ring 93 is fixed by a screw 78 to the pipe 72, at a substantially intermediate vertical position on the pipe 72.

A slide bearing member 84 is integrally secured to a lower portion of the housing 60 (see FIG. 3). The pipe 72 is rotatably supported by the slide bearing member 84. The slide bearing member 84 (see FIG. 5) is of a stepped hollow cylindrical shape, having a lower distal end portion 84*a*. Bushings 86, 88 are press-fitted into the lower distal end portion 84*a*, respectively, on an inner circumferential lower end surface, and on a stepped inner circumferential surface of the inner wall surface of the lower distal end portion 84*a*. The bushings 86, 88 have an inside diameter slightly greater than the outside diameter of the pipe 72. The upper bushing 86 is of a flanged shape, including the flange 86*a* that is held against an upper surface of an inner step of the slide bearing member 84.

The slide bearing member 84 has square holes 84*b* defined in respective left and right side surfaces thereof, at a substantially intermediate vertical position on the lower distal end portion 84*a*. The pipe 72 has side surfaces exposed through the square holes 84*b*. The exposed side surfaces can be gripped by two gripper arms 58*a* of the chuck 58 (see FIG. 10). The pipe 72 can swing within the range of the gap formed between itself and the bushings 86, 88. When the pipe 72 is gripped by the gripper arms 58*a*, the pipe 72 is maintained accurately coaxial with the slide bearing member 84.

Figure 7:
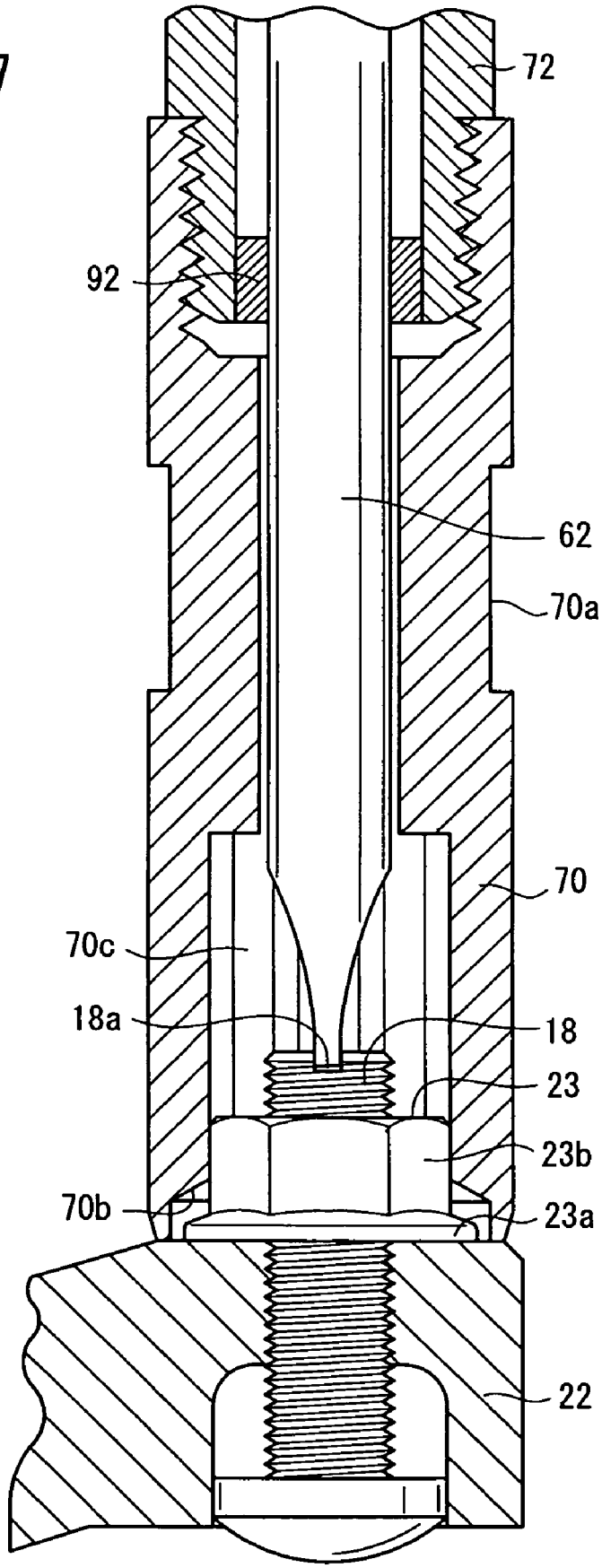
FIG. 7 is an enlarged cross-sectional front elevational view of a socket and related parts.

As shown in FIG. 7, a bushing 92 is press-fitted into the distal end of the pipe 72. The screwdriver 62 has a distal end portion rotatably supported by the bushing 92, with essentially no gap formed therebetween. The socket 70 has an upper portion threaded over an outer wall surface of the distal end of the pipe 72. The bushing 92 preferably is disposed between a lower ½-long portion of the pipe 72 and the screwdriver 62, or between the socket 70 and the screwdriver 62, for holding the distal end portion of the screwdriver 62 accurately coaxial with the socket 70. The pipe 72 and the socket 70 have respective tool engaging surfaces 72*c*, 70*a* defined on side surfaces thereof, which permit tools to engage therewith when the socket 70 is threaded over the pipe 72. The socket 70 can easily be replaced with respect to the pipe 72 using such tools.

The socket 70 has a distal end portion thereof which is larger in diameter than the flange 23*a*, and which includes an inner wall surface in the form of a dodecagonal socket surface 70*c* for engaging a nut surface 23*b* of the adjustment nut 23. The socket 70 also includes an annular beveled surface 70*b* on an inner circumferential surface of the distal end thereof, for avoiding abutment against the flange 23*a*. The inner wall surface of the socket 70 may comprise a hexagonal socket surface.

Figure 8:
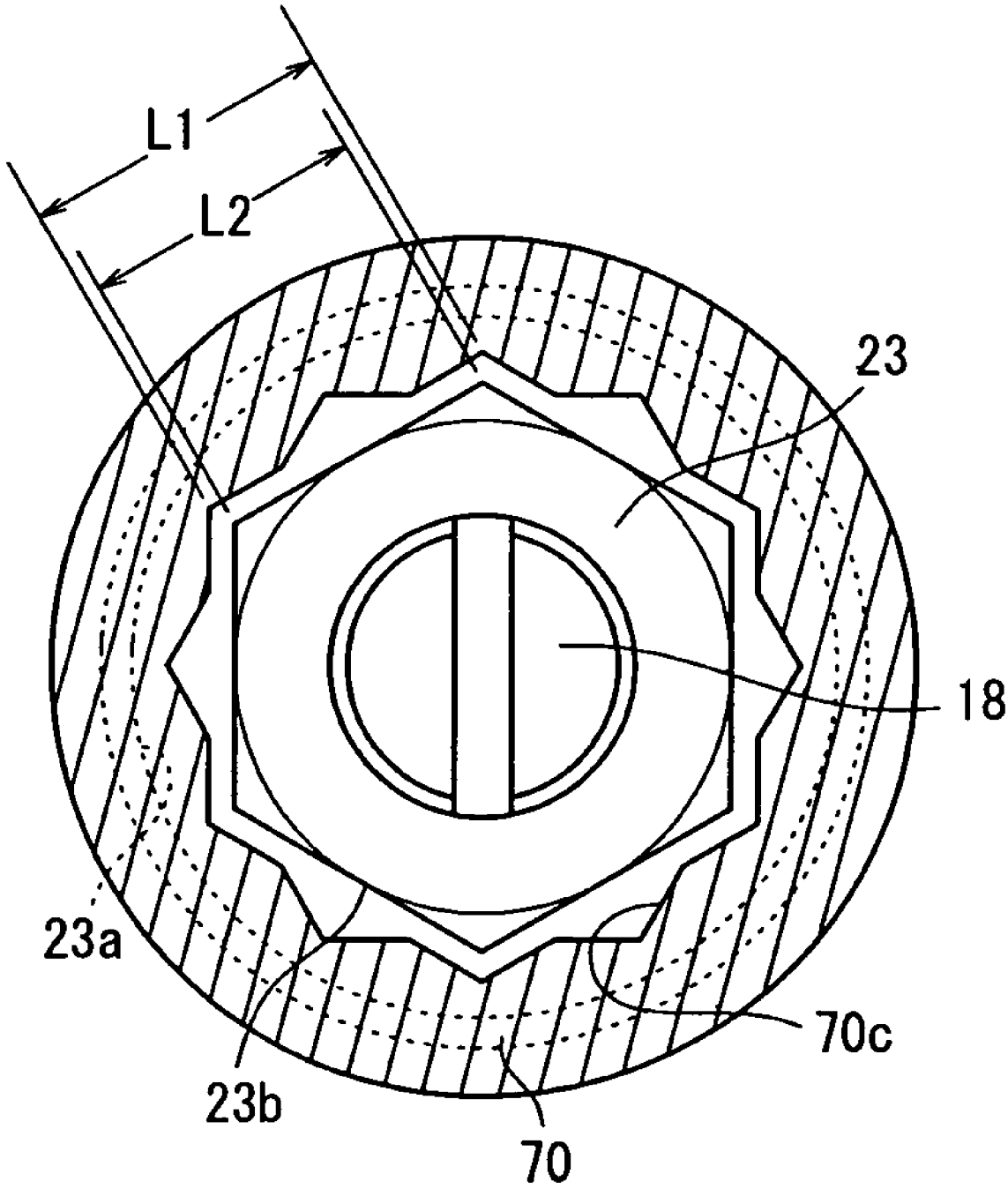
FIG. 8 is a horizontal cross-sectional view of the socket.

As shown in FIG. 8, the inner wall surface of the socket 70 has engaging sides, each having a dimension L1 greater than the dimension L2 of corresponding engaged sides of the adjustment nut 23, the ratio L1/L2 being set to a value ranging from 1.20 to 1.45. If the side of the inner wall surface of the socket 70 is too small, then the socket 70 cannot easily be fitted against the nut surface 23*b* of the adjustment nut 23. If the side of the inner wall surface of the socket 70 is too large, then the socket 70 fails to sufficiently engage the adjustment nut 23 for enabling rotation thereof. In view of these considerations, the ratio L1/L2 should preferably be in the range of from 1.20 to 1.45.

Figure 9:
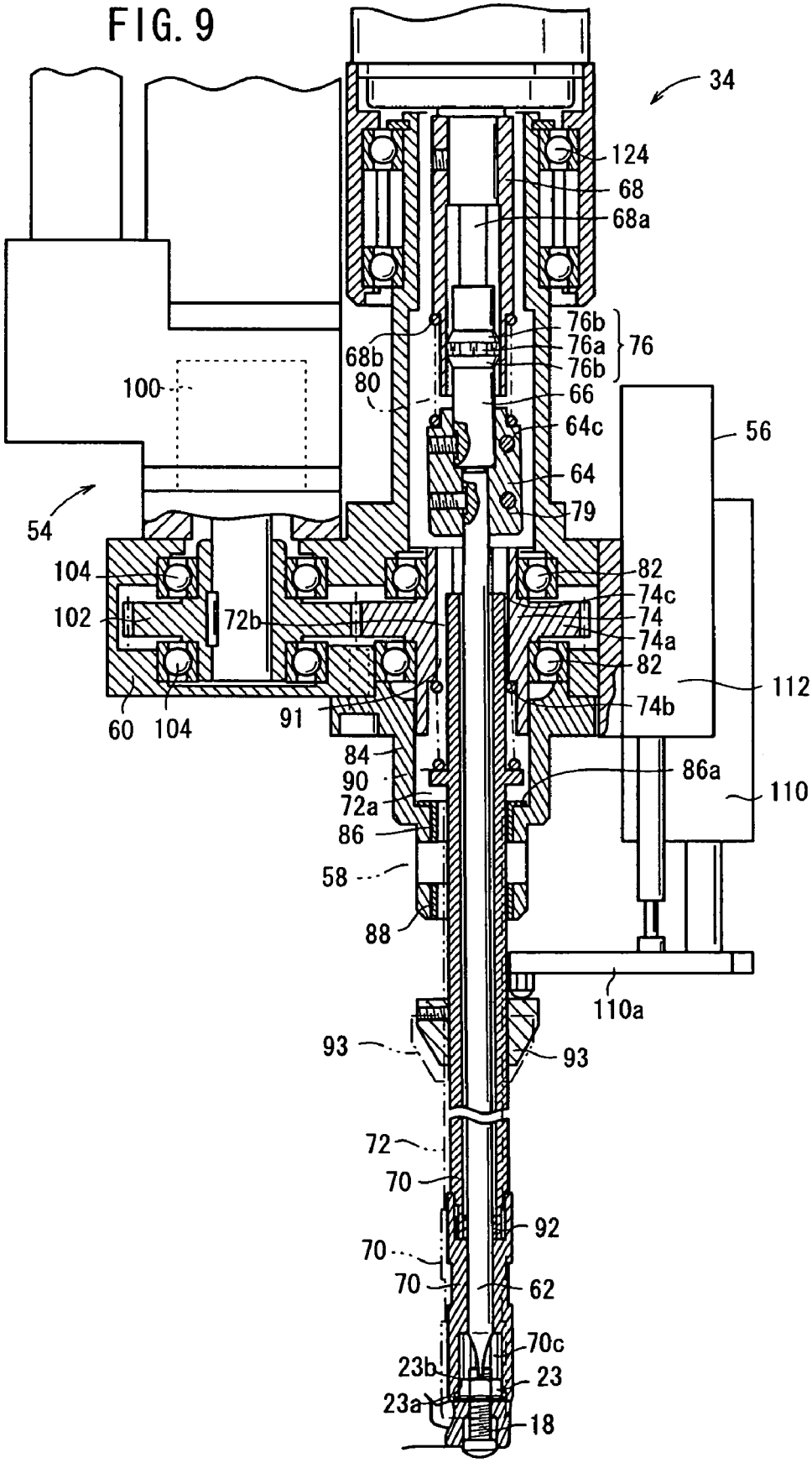
FIG. 9 is a cross-sectional front elevational view showing a screwdriver, the pipe, and the socket, which are tilted.

With the adjustment unit 34 thus constructed, a gap 91 is provided between the hexagonal post 72*b* of the pipe 72 and the inner wall surface of the hexagonal hole 74*c* in the gear body 74, such that the insert 66 is tiltable inside the sleeve 68. Therefore, when the screwdriver 62 engages the adjustment screw 18, as shown in FIG. 9, the socket 70 on the distal end of the pipe 72 is tilted concentrically with the screwdriver 62 and is properly fitted over the adjustment screw 18. Particularly, the socket 70 and the screwdriver 62 are maintained accurately concentric with each other by means of the bushing 92 disposed in the distal end of the pipe 72, thus allowing the screwdriver 62 to adjust the adjustment screw 18 while the socket 70 concurrently rotates the adjustment nut 23.

When the screwdriver 62 and the socket 70 are not held in abutment against the adjustment screw 18 and the adjustment nut 23, respectively, the lower surface of the adapter 64 is pressed against the upper surface of the gear body 74 under the resiliency of the helical spring 80, so as to keep the screwdriver 62 normally erect. Also, the lower surface of the annular ridge 72*a* is pressed against the upper surface of the flange 86*a* of the bushing 86 under the resiliency of the helical spring 90, so as to keep the pipe 72 normally erect.

The components, other than the working unit 50, of the adjustment unit 34 shall be described below. As shown in FIGS. 3 and 4, the nut runner 54 comprises a socket motor 100 energizable by the PLC 42, a drive gear 102 connected to the rotatable shaft of the socket motor 100, and bearings 104 which rotatably support the drive gear 102. The drive gear 102 is held in mesh with a driven gear 74*a*. When the socket motor 100 is energized, the drive gear 102, the driven gear 74*a*, and the pipe 72 are rotated in order to rotate the socket 70. The drive gear 102 and the driven gear 74*a* are covered by the housing 60.

The displacement measuring unit 56 comprises a pneumatic cylinder 110 for bringing a plate 110*a* on a distal end thereof into abutment against the ring 93, and a magnescale 112 coupled to the plate 110*a* for measuring the position of the ring 93, so as to detect displacement of the rocker arm 22 in real time. The pneumatic cylinder 110 and the magnescale 112 are mounted on a joint bracket 114 that is connected to the robot 36. The pneumatic cylinder 110 may be small in size and weight, as it serves to make measurements and does not need to produce a large output.

The drive measuring unit 52 comprises a servomotor (first rotational driver) 120 energizable by the PLC 42, and the torque detector 38, which is connected to the servomotor 120. The torque detector 38 is connected to the sleeve 68. When the servomotor 120 is energized, the torque detector 38, the sleeve 68, and the adapter 64 are rotated in order to rotate the screwdriver 62. A bearing box 124 is disposed between the drive measuring unit 52 and the working unit 50.

Figure 10:
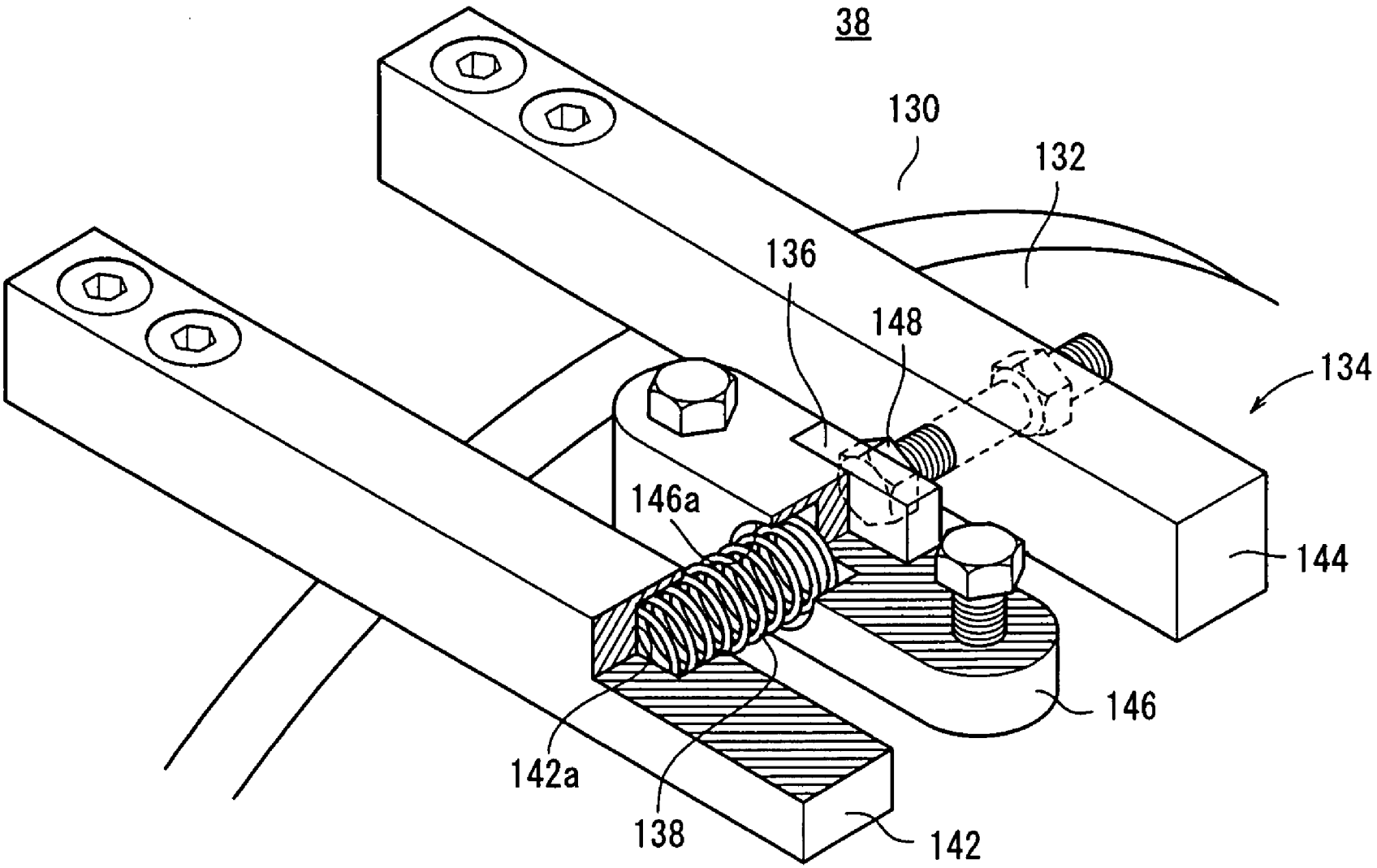
FIG. 10 is a perspective view, partly in cross section, of a torque detector.

As shown in FIG. 10, the torque detector 38 comprises a stepped cylindrical first coupling 130, a hollow cylindrical second coupling 132 disposed coaxially with and downwardly from the first coupling 130, a drive force transmitting engagement unit 134 for transmitting rotation of the first coupling 130 to the second coupling 132. A bearing 140 (see FIG. 4) is disposed between a downwardly projecting cylindrical member 130*a* of the first coupling 130 and an inner circumferential surface of the second coupling 132. The second coupling 132 is connected to the sleeve 68 by a given coupling means. The first coupling 130 and the second coupling 132 have essentially the same outside diameter.

The torque detector 38 includes two fixing dogs 142, 144 mounted on a side surface of the first coupling 130 and projecting downwardly (downwardly to the right as shown in FIG. 10), an engaging member 146 mounted on a side surface of the second coupling 132 and disposed between the fixing dogs 142, 144, a load cell 136, a spring (resilient member) 138, and a pressing adjustment bolt 148. As viewed from the engaging member 146, the fixing dog 142 is disposed on the left side and the fixing dog 144 is disposed on the right side.

The spring 138 has one end inserted into a bottomed circular hole 142*a* defined in a right side surface of the fixing dog 142, and another end inserted into a bottomed circular hole 146*a* defined in a left side surface of the engaging member 146. The spring 138 is slightly compressed. The load cell 136 is mounted on the right side surface of the engaging member 146 and is held against an end of the pressing adjustment bolt 148 on the fixing dog 144. A leftward projection of the pressing adjustment bolt 148 is adjustable in order to adjust the compression of the spring 138. Actually, if the load cell 136 has a measurement range of 100 N, then the pressing adjustment bolt 148 is turned so as to adjust the compression of the spring 138, to apply a preload of 50 N (=100 N/2) to the load cell 136 when the load cell 136 is under no load. Therefore, a torque applied in one direction to the second coupling 132 is proportionally detected by the load cell 136 as a force that is equal to or greater than 50 N, and a torque applied in the reverse direction is proportionally detected as a force that is equal to or smaller than 50 N. The force detected by the load cell 136 is supplied to the PLC 42, which subtracts the preload of 50 N so as to cancel the offset, and converts the force into a torque value T in view of the diameter of the second coupling 132.

According to a general torque detecting process that measures a circumferential strain with a strain gage, the strain is small when the torque is very small. Therefore, the general torque detecting process is not suitable for detecting very small torques applied to rotate the screwdriver 62, and the torque detecting process exhibits poor linearity.

The torque detector 38 can detect bidirectional torque values T with a simple and inexpensive structure, using the single load cell 136. When the load cell 136 is preloaded by the spring 138, there is no clearance between the load cell 136 and the pressing adjustment bolt 148, making it possible to measure torque in a manner that is free of dead zones. Since the first coupling 130 and the second coupling 132 are kept in a floating state by the bearing 140 (see FIG. 4), even very small torques can be measured highly accurately, without being affected by friction, and linearity is excellent.

Figure 11:
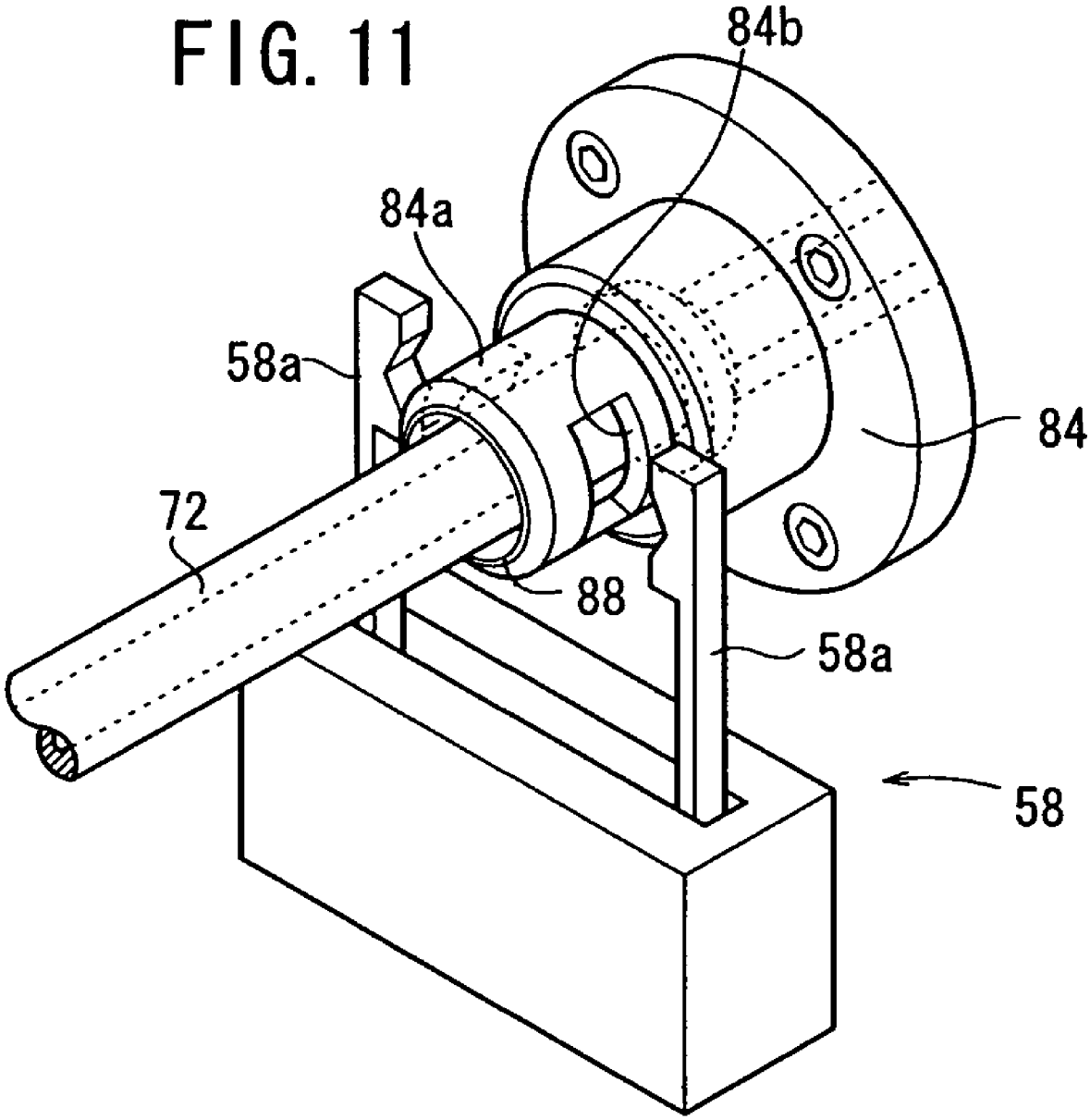
FIG. 11 is a perspective view of a chuck, a bearing member, and related parts.

As shown in FIG. 11, the chuck 58 has two gripper arms 58*a* for gripping the side surfaces of the pipe 72 that are exposed through the square holes 84*b*. Particularly, when the position of the ring 93 needs to be accurately measured by the displacement measuring unit 56, the chuck 58 holds and secures the pipe 72. The chuck 58 is controlled during operation by the PLC 42.

A method of adjusting the tappet clearance C of the engine 12 using the tappet clearance adjusting apparatus 10 thus constructed shall be described below.

The robot controller 44 operates the robot 36 in order to move the adjustment unit 34 close to the engine 12, and to cause the socket 70 of the working unit 50 to approach the adjustment nut 23.

At this time, even if the central axis of the working unit 50 is slightly displaced off the axis of the adjustment screw 18, since the opening of the socket 70 has an annular beveled surface 70*b*, and the dodecagonal socket surface 70*c* is larger than the nut surface 23*b* of the adjustment nut 23, the adjustment nut 23 at least enters the opening of the socket 70. Thereafter, when the working unit 50 moves further toward the rocker arm 22, since the screwdriver 62 and the pipe 72 are in a floating state, the pipe 72, which is connected to the socket 70, slides along the direction of the nut surface 23*b* while the socket 70 is fitted progressively over the adjustment nut 23 (see FIG. 9).

Specifically, since gaps are present between the side surface of the pipe 72 and the bushings 86, 88 as well as between the side surface of the pipe 72 and the inner wall surface of the hexagonal hole 74*c* of the gear body 74, the pipe 72 is tilted within the range of these gaps, passively in the direction along the nut surface 23*b*. At this time, the screwdriver 62 is kept concentric with the socket 70 by the bushing 92, while the tilt support 76 of the insert 66 is tiltable with respect to the sleeve 68. Therefore, the screwdriver 62 is tilted in unison with the socket 70 and the pipe 72, in coaxial alignment with the adjustment screw 18.

If the socket 70 rides onto the flange 23*a*, then since the adjustment nut 23 moves laterally and is pressed from above, the torque on the adjustment screw 18 tends to be changed. In the tappet clearance adjusting apparatus 10, however, as shown in FIG. 7, since the opening of the socket 70 has an annular beveled surface 70*b*, the socket 70 does not ride onto the flange 23*a*, but rather, the end face thereof is seated accurately on the upper surface of the rocker arm 22, and the dodecagonal socket surface 70*c* and the nut surface 23*b* engage appropriately with each other for adequately rotating the adjustment nut 23.

At this time, depending on the position of the working unit 50, the helical springs 80, 90 are somewhat compressed, so as to press the socket 70 and the screwdriver 62 appropriately against the rocker arm 22 and the adjustment screw 18. The hexagonal post 72*b* of the pipe 72 slides inside the hexagonal hole 74*c* of the gear body 74, and the insert 66 slides inside the hexagonal hole 68*a* of the sleeve 68.

Then, the socket motor 100 of the nut runner 54 is energized in order to rotate the pipe 72 and the socket 70 counterclockwise as viewed in plan and loosen the adjustment nut 23. At this time, inasmuch as the hexagonal post 72*b* engages within the hexagonal hole 74*c*, the rotational drive force is effectively transmitted to the pipe 72 and the socket 70.

The rotation of the socket 70 unfastens the adjustment nut 23, which is in a double-nut configuration on the adjustment screw 18, which now becomes rotatable. At this time, the adjustment screw 18 may be rotated in a direction that tightens the adjustment screw 18. An increase in torque applied to the socket 70 may be detected by the torque detector 38, in order to confirm the fitting engagement between the socket 70 and the adjustment nut 23.

Then, the servomotor 120 is energized in order to cause the sleeve 68 and the insert 66 to rotate the screwdriver 62 clockwise as viewed in plan, so that the screwdriver 62 projects downwardly. At this time, since the screwdriver 62 and the socket 70 are accurately kept concentric with each other by the bushing 92, the tip end of the screwdriver 62 is properly inserted into the straight slot 18*a* of the adjustment screw 18. Accordingly, undue external forces due to incomplete fitting engagement are prevented, and thus the screwdriver 62 has an increased service life. Apparatus shutdown and reengagement operations, due to incomplete fitting engagement, also are suppressed, thereby increasing apparatus availability.

Thereafter, the PLC 42 starts measuring the torque value T, based on the measurement by the load cell 136, and the angular displacement of the servomotor 120, and measures the torque value and the angular displacement successively at predetermined small time intervals.

Figure 12:
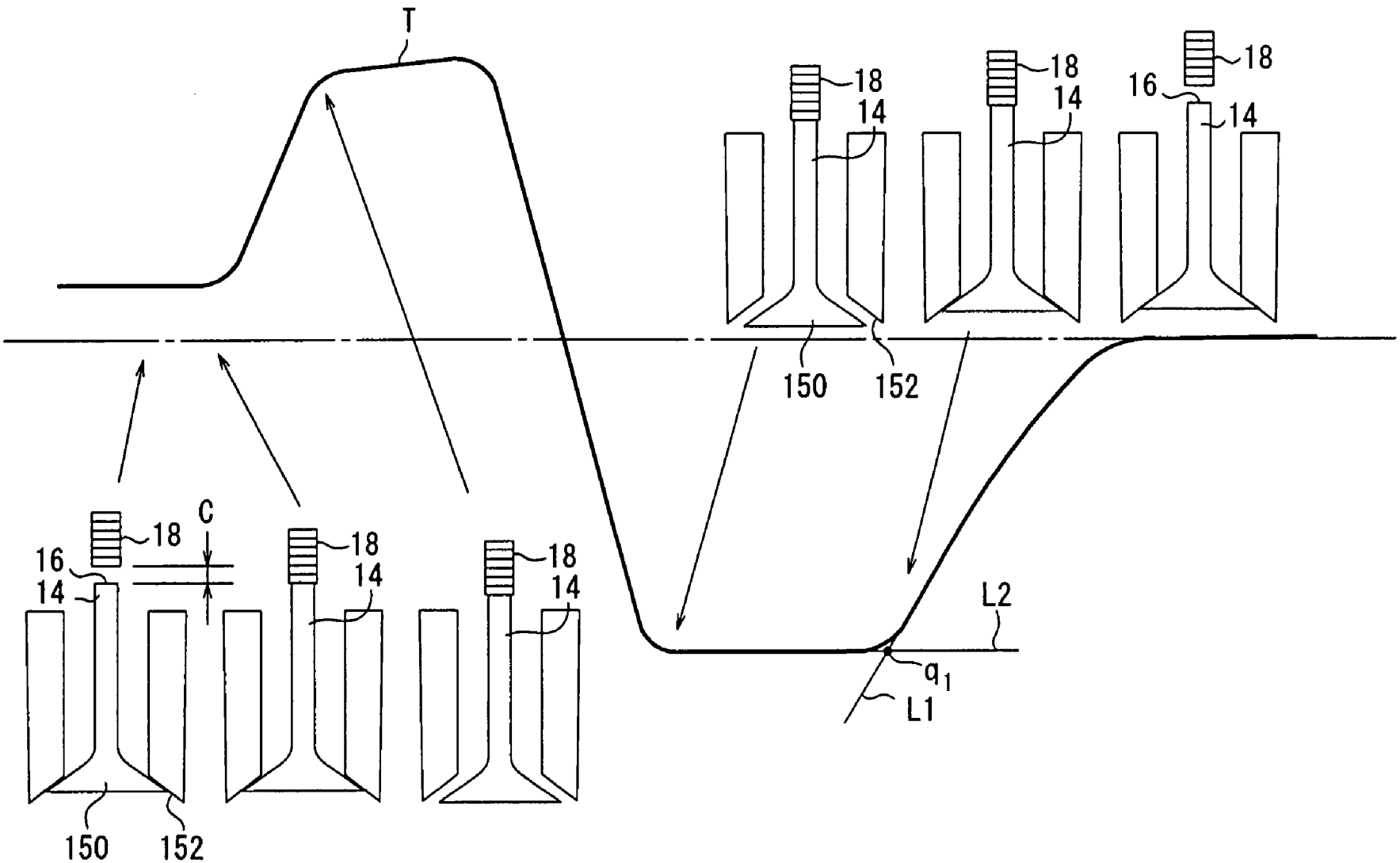
FIG. 12 is a diagram showing a comparison between torque value variations and valve states.

As shown in FIG. 12, when the adjustment screw 18 projects downwardly into engagement with the valve end 16 (i.e., when the clearance C becomes C=0), the valve head 150 starts being lifted. After mechanical flexure and play are removed, and the valve head 150 is unseated off of the valve seat 152, the torque T exhibits a substantially constant value.

After the PLC 42 has detected when the torque value T becomes substantially constant, the servomotor 120 is reversed. The torque value T quickly decreases to invert its polarity, and the torque value T continuously decreases to an absolute value that is substantially equal to the value achieved before the torque value was inverted in polarity. Thereafter, the torque gradually increases (the absolute value thereof decreases).

After the valve head 150 has contacted the valve seat 152, the torque value T quickly increases (the absolute value thereof decreases). After the valve 14 has been completely closed, the adjustment screw 18 is spaced from the valve end 16, whereupon the torque value T becomes substantially nil.

Figure 13:
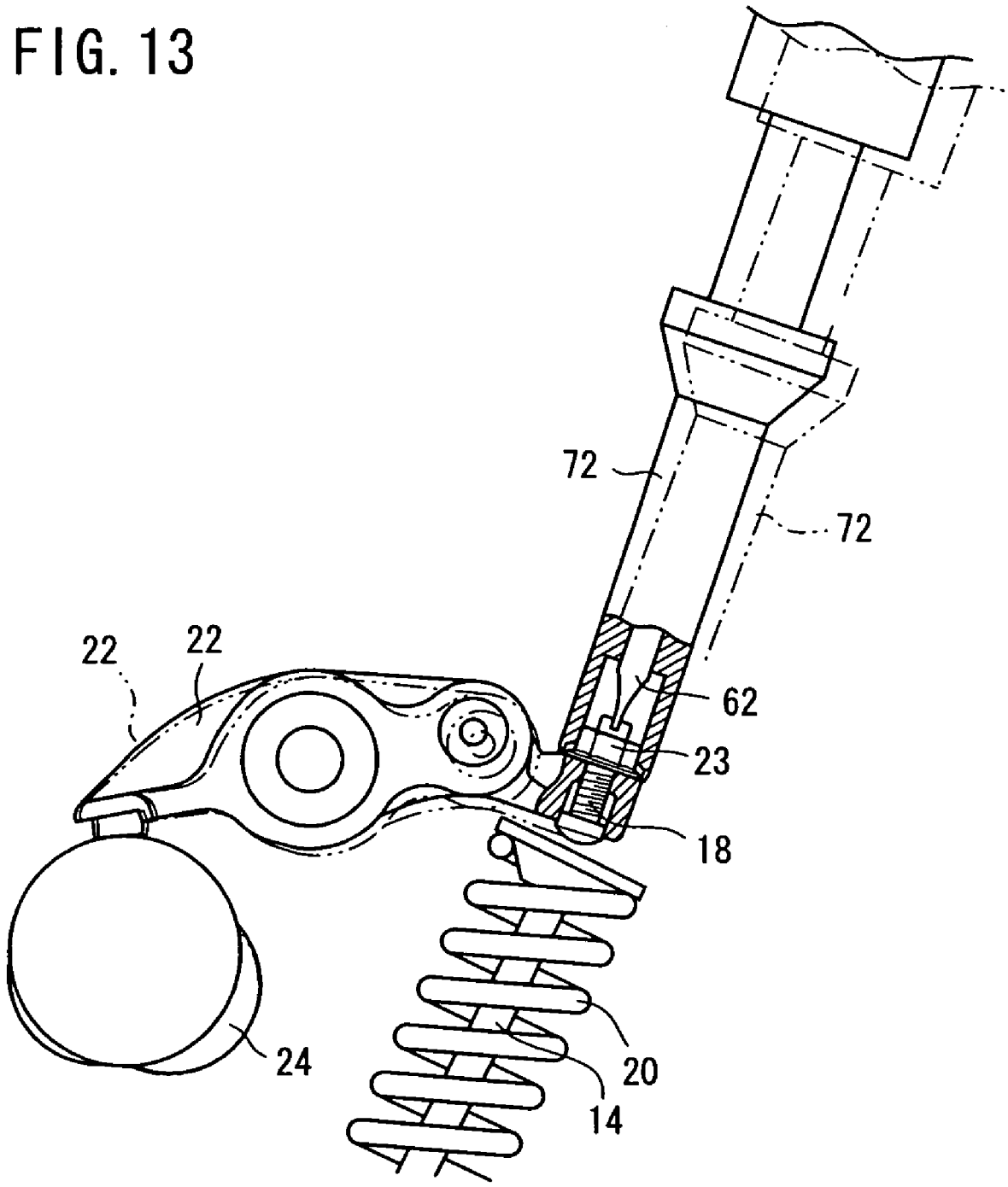
FIG. 13 is a diagram showing the manner in which the screwdriver and the socket are tilted depending on the displacement of a rocker arm.

While the adjustment screw 18 is operated, the rocker arm 22 is slightly tilted as shown in FIG. 13, and the robot 36 moves the adjustment unit 34 in synchronism with tilting movement of the rocker arm 22. Even if the synchronizing operation suffers a slight error, the screwdriver 62 and the socket 70 are tilted passively, depending on the tilting movement of the rocker arm 22, the adjustment screw 18, and the adjustment nut 23, so that the socket 70 and the screwdriver 62 remain appropriately fitted over the adjustment screw 18 and the adjustment nut 23.

Having detected the series of torque values T (see FIG. 12), in the following manner, the PLC 42 calculates a position q1 at which the valve head 150 is closed. The PLC 42 determines an approximate straight line L2 within an interval at which the torque value T is substantially constant after the adjustment screw 18 has been reversed, and an approximate straight line L1 within a subsequent interval at which the torque value T increases. The PLC 42 also determines a point of intersection between the approximate straight lines L1 and L2, and sets the determined point as the position q1.

Thereafter, the adjustment screw 18 is retracted a predetermined distance from the position q1, in order to establish an appropriate tappet clearance C. Subsequently, the socket motor 100 is energized to rotate the socket 70, so as to fasten the adjustment screw 18 in a double-nut configuration.

With the tappet clearance adjusting apparatus 10 according to the present embodiment, as described above, the tilt support 76 is axially movable back and forth inside the sleeve 68, and effectively bears the rotational drive force while abutting against the inner wall surface of the hexagonal hole 68*a* of the sleeve 68. Also, the tilt support 76 is slightly tiltable in any direction, i.e., is disposed in the floating state. Consequently, the screwdriver 62, which is fixed to the tilt support 76, also is tiltable in any direction depending on the direction of the adjustment screw 18, and engages with the adjustment screw 18 in an appropriate direction.

The screwdriver 62 thus is rotatable smoothly in unison with the adjustment screw 18, without being affected by the tilt angle of the rocker arm 22. Also, the torque value T for rotating the adjustment screw 18 can be detected highly accurately by the load cell 136. Therefore, the approximate straight lines L1, L2, as well as the position q1 (see FIG. 12), are accurately determined based on the torque value T, for thereby appropriately setting the tappet clearance C.

The pipe 72 that is disposed concentric with the screwdriver 62 is axially movable toward and away from the gear body 74, and is rotatable by engagement with an inner wall surface thereof. The pipe 72 is also tiltable within a range of the gap 91 (see FIG. 6), which is provided between the pipe 72 and the inner wall surface of the hexagonal hole 74*c*, depending on the tilt of the screwdriver 62. In other words, the pipe 72 and the socket 70 also are disposed in a floating state, similar to the screwdriver 62, and are accurately held concentrically with each other by the bushing 92. Therefore, when the screwdriver 62 engages the adjustment screw 18, the socket 70 is tilted concentrically with the screwdriver 62, and is properly fitted over the adjustment nut 23. The adjustment nut 23 thus can be rotated appropriately for adjusting the adjustment screw 18. The tappet clearance adjusting apparatus 10 may also be applied to an adjustment nut 23, which does not include the flange 23*a*.

Although the present exemplary embodiments of the invention have been discussed above, it will be understood that variations and modifications may be made thereto within the scope of the appended claims.

The invention claimed is:

1. A tappet clearance adjusting apparatus for adjusting a clearance between an adjustment screw with an adjustment nut threaded thereover and a valve end of an engine, comprising:

a screwdriver for rotating said adjustment screw;

a first rotational driver for rotating said screwdriver;

a sleeve connected to a rotatable shaft of said first rotational driver, said sleeve having a noncircular inner circumferential surface;

an insert connected to an upper end of said screwdriver and including at least a portion thereof which is inserted into said sleeve;

a pipe disposed concentrically around said screwdriver and supporting a socket for rotating said adjustment nut on a distal end thereof; and a second rotational driver disposed concentrically with said pipe for rotating said pipe, wherein said portion of said insert which is inserted into said sleeve has an axially short tilt support held in abutment against an inner wall surface of said sleeve, said second rotational driver has a noncircular inner wall, said pipe has a portion inserted into said noncircular inner wall and having a noncircular outer wall, and said pipe has a maximum outside diameter smaller than a maximum inside diameter of said noncircular inner wall, and greater than a minimum inside diameter of said noncircular inner wall.

2. A tappet clearance adjusting apparatus according to claim 1, wherein said tilt support has an axial length ranging from 1/10 to 1/2 the maximum diameter of the inner wall surface of said sleeve.

3. A tappet clearance adjusting apparatus according to claim 1, further comprising a bushing disposed between said socket and said screwdriver in a direction of said socket and said screwdriver.

4. A tappet clearance adjusting apparatus according to claim 1, further comprising a torque detector for detecting a torque used for rotating said adjustment screw;

said torque detector comprising:

a first coupling connected to said first rotational driver;

a second coupling coupled to said screwdriver and coaxial with said first coupling;

a drive force transmitting engagement unit for transmitting a bidirectional rotation of said first coupling to said second coupling; and a load cell mounted on said drive force transmitting engagement unit for detecting a force in a circumferential direction, wherein said load cell is preloaded in said circumferential direction by a resilient member.

5. A tappet clearance adjusting apparatus according to claim 1, wherein said adjustment nut comprises a nut with a flange, said socket having a distal end thereof, which is greater in diameter than said flange, and an annular beveled surface on an inner circumferential surface of said distal end thereof, for avoiding abutment with said flange.

6. A tappet clearance adjusting apparatus according to claim 5, wherein said socket has an inner wall surface including a portion engaging said adjustment nut, and having a dimension which is 1.20 to 1.45 times greater than a dimension of an engaged portion of said adjustment nut.

7. A tappet clearance adjusting apparatus according to claim 1, further comprising a bushing disposed between said screwdriver and a reduced diameter portion of said pipe in a direction of said pipe and said screwdriver.

* * * * *